US011607093B2

(12) United States Patent
Rukavina

(10) Patent No.: US 11,607,093 B2
(45) Date of Patent: Mar. 21, 2023

(54) FLOOR CLEANER WITH FULL TANK INDICATOR

(71) Applicant: Techtronic Cordless GP, Anderson, SC (US)

(72) Inventor: Douglas M. Rukavina, Concord, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 47 days.

(21) Appl. No.: 17/238,026

(22) Filed: Apr. 22, 2021

(65) Prior Publication Data

US 2021/0330150 A1 Oct. 28, 2021

Related U.S. Application Data

(60) Provisional application No. 63/015,071, filed on Apr. 24, 2020.

(51) Int. Cl.

| | |
|---|---|
| ***A47L 7/00*** | (2006.01) |
| ***A47L 9/18*** | (2006.01) |
| ***A47L 9/28*** | (2006.01) |
| ***A47L 11/30*** | (2006.01) |
| ***A47L 11/40*** | (2006.01) |

(52) U.S. Cl.

CPC ..... *A47L 7/0028* (2013.01); *A47L 7/0023* (2013.01); *A47L 9/186* (2013.01); *A47L 9/2857* (2013.01); *A47L 11/30* (2013.01); *A47L 11/4008* (2013.01); *A47L 11/4019* (2013.01)

(58) Field of Classification Search

CPC ..... A47L 7/0028; A47L 7/0023; A47L 9/186; A47L 9/2857; A47L 11/30; A47L 11/4008; A47L 11/4019

See application file for complete search history.

(56) References Cited

U.S. PATENT DOCUMENTS

| | | | |
|---|---|---|---|
| 3,818,537 | A | 6/1974 | Evans |
| 4,238,869 | A | 12/1980 | Lachance |

(Continued)

FOREIGN PATENT DOCUMENTS

| | | | |
|---|---|---|---|
| CN | 102805595 | B | 9/2015 |
| CN | 206548433 | U | 10/2017 |

(Continued)

OTHER PUBLICATIONS

International Search Report and Written Opinion for Application No. PCT/US/2021/028695 dated Jul. 13, 2021 (12 pages).

*Primary Examiner* — Andrew A Horton

(74) *Attorney, Agent, or Firm* — Michael Best & Friedrich LLP

(57) ABSTRACT

A floor cleaner includes a recovery tank including an inflow path allowing liquid-laden air to enter the recovery tank, an outflow path allowing air to exit the recovery tank; and a chamber for storing liquid. The chamber includes an inlet, a separator that separates liquid from the liquid-laden air, an air outlet, and a float. The float includes a base and a valve with an indicator. The float is moveable between a first position and a second position. In the first position the valve is spaced away from the air outlet and air is allowed to exit the chamber. In the second position the valve is adjacent the outlet and impedes air from exiting the chamber. In the second position the indicator is visible when the chamber is full.

22 Claims, 9 Drawing Sheets

(56) References Cited

U.S. PATENT DOCUMENTS

| | | | |
|---|---|---|---|
| 5,394,587 | A | 3/1995 | Parise |
| 5,664,284 | A | 9/1997 | Brzoska |
| 6,113,663 | A | 9/2000 | Liu |
| 6,117,713 | A | 9/2000 | Hoshino et al. |
| 6,533,833 | B1 | 3/2003 | Schmitz |
| 6,721,990 | B2 | 4/2004 | Zahuranec et al. |
| 7,073,226 | B1 | 7/2006 | Lenkiewicz et al. |
| RE39,304 | E | 9/2006 | Kasen et al. |
| 7,779,505 | B2 | 8/2010 | Krebs et al. |
| 9,629,513 | B2 | 4/2017 | Hill et al. |
| 10,238,260 | B2 | 3/2019 | Lenkiewicz et al. |
| 10,327,616 | B2 | 6/2019 | Moyher, Jr. et al. |
| 10,342,402 | B2 | 7/2019 | Lenkiewicz et al. |
| 10,376,124 | B2 | 8/2019 | McDowell et al. |
| 2002/0042965 | A1 | 4/2002 | Salem et al. |
| 2016/0331201 | A1 | 11/2016 | Goff |
| 2019/0133398 | A1* | 5/2019 | Chavana, Jr. ..... A47L 11/34 |

FOREIGN PATENT DOCUMENTS

| | | | |
|---|---|---|---|
| EP | 3482668 | A1 | 5/2019 |
| FR | 2844697 | A1 | 3/2004 |

* cited by examiner

FLOOR CLEANER WITH FULL TANK INDICATOR

CROSS-REFERENCE TO RELATED APPLICATIONS

This application claims priority to U.S. Provisional Patent Application No. 63/015,071, filed Apr. 24, 2020, the entire contents of which are hereby incorporated by reference herein.

BACKGROUND

The present invention relates to floor cleaners.

SUMMARY

In one embodiment a floor cleaner is disclosed including a recovery tank with an inflow path allowing liquid-laden air to enter the recovery tank, an outflow path allowing air to exit the recovery tank, and a chamber for storing liquid. The chamber includes an inlet, an outlet, a separator that separates liquid from the liquid-laden air, and a float. The float includes a base and a valve with an indicator. The float is moveable between a first position with the valve spaced away from the air outlet, allowing air to exit the chamber, and a second position with the valve adjacent the outlet, impeding the air form exiting the chamber. In the second position the indicator is visible when the chamber is full.

In another embodiment, a floor cleaner is disclosed including an inlet, an outlet, a suction source operable to generate a suction airflow through the inlet and the outlet, a fluid flow path extending from the inlet to the outlet, a recovery tank positioned in the flow path and including a recovery tank inlet and a recovery tank outlet, and a float. The float obstructs the recovery tank outlet in a closed position in response to a fluid level in the recovery tank. The float includes an indicator visible when the float is in the closed position to indicate to the user that the float is in the closed position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

The disclosure relates to a floor cleaner having a liquid recovery system including a suction source that draws liquid-laden air from a dirty air inlet, such as a suction nozzle, along a fluid flow path to a recovery tank. The recovery tank includes an air/liquid separator that separates recovered liquid, such as water or other cleaning solution, from the liquid-laden air entering the recovery tank and retains the separated liquid in the in the recovery tank.

Figure 1:
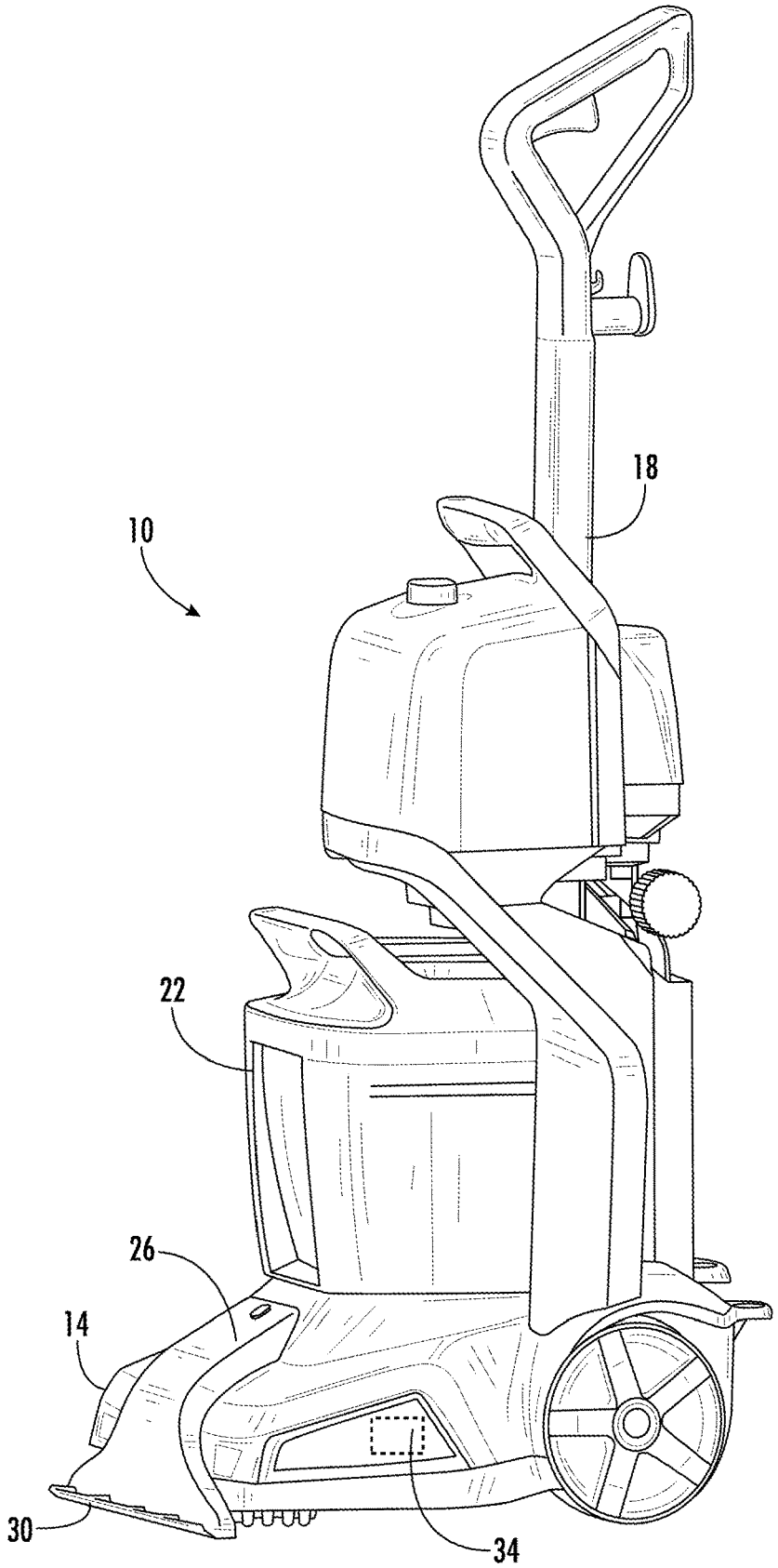
FIG. 1 is a perspective view of a floor cleaner according to one embodiment shown with a handle in an upright storage position.
Figure 2A:
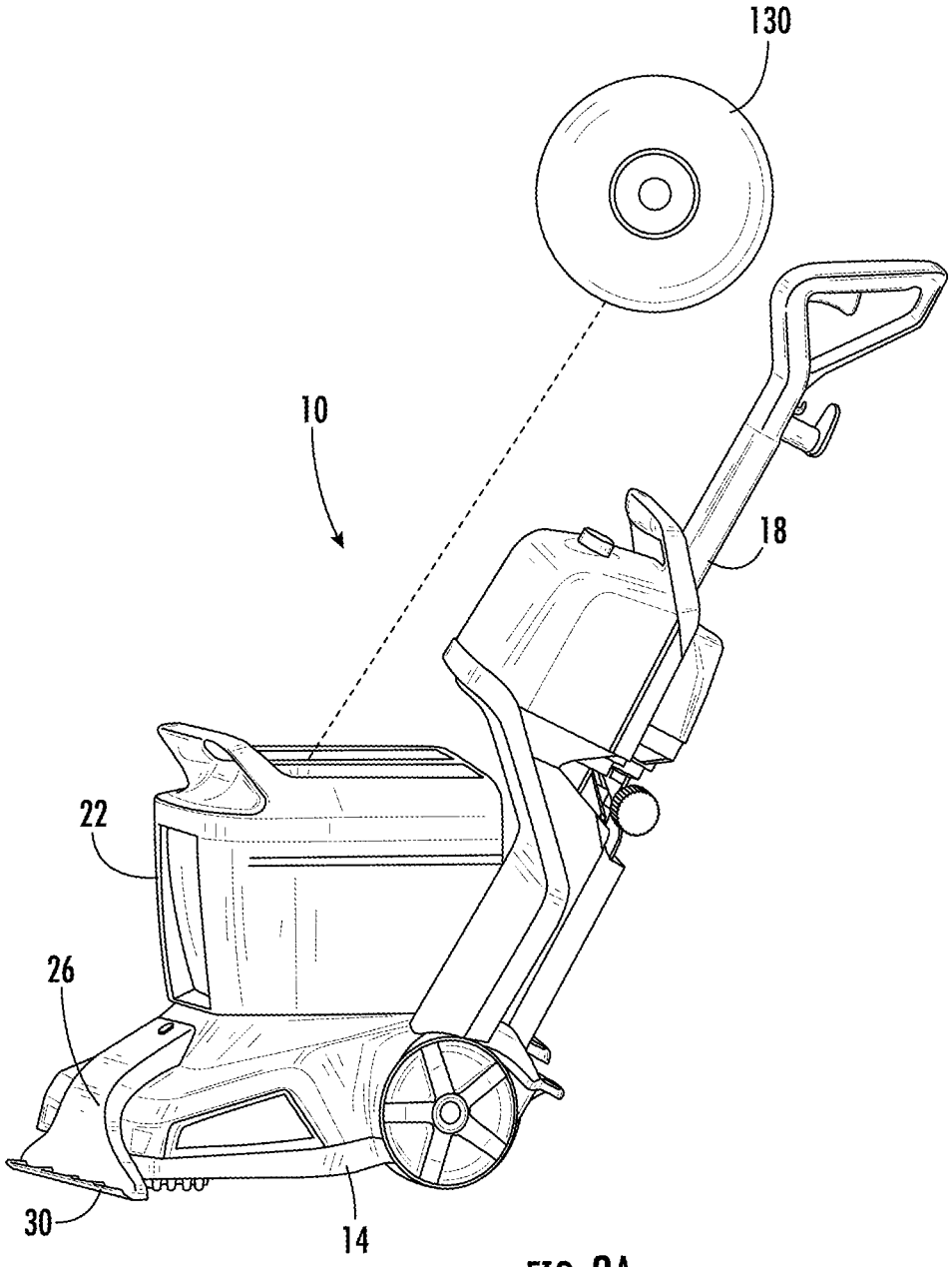
FIG. 2A is a perspective view of the floor cleaner of FIG. 1 with the handle in an inclined use position.
Figure 2B:
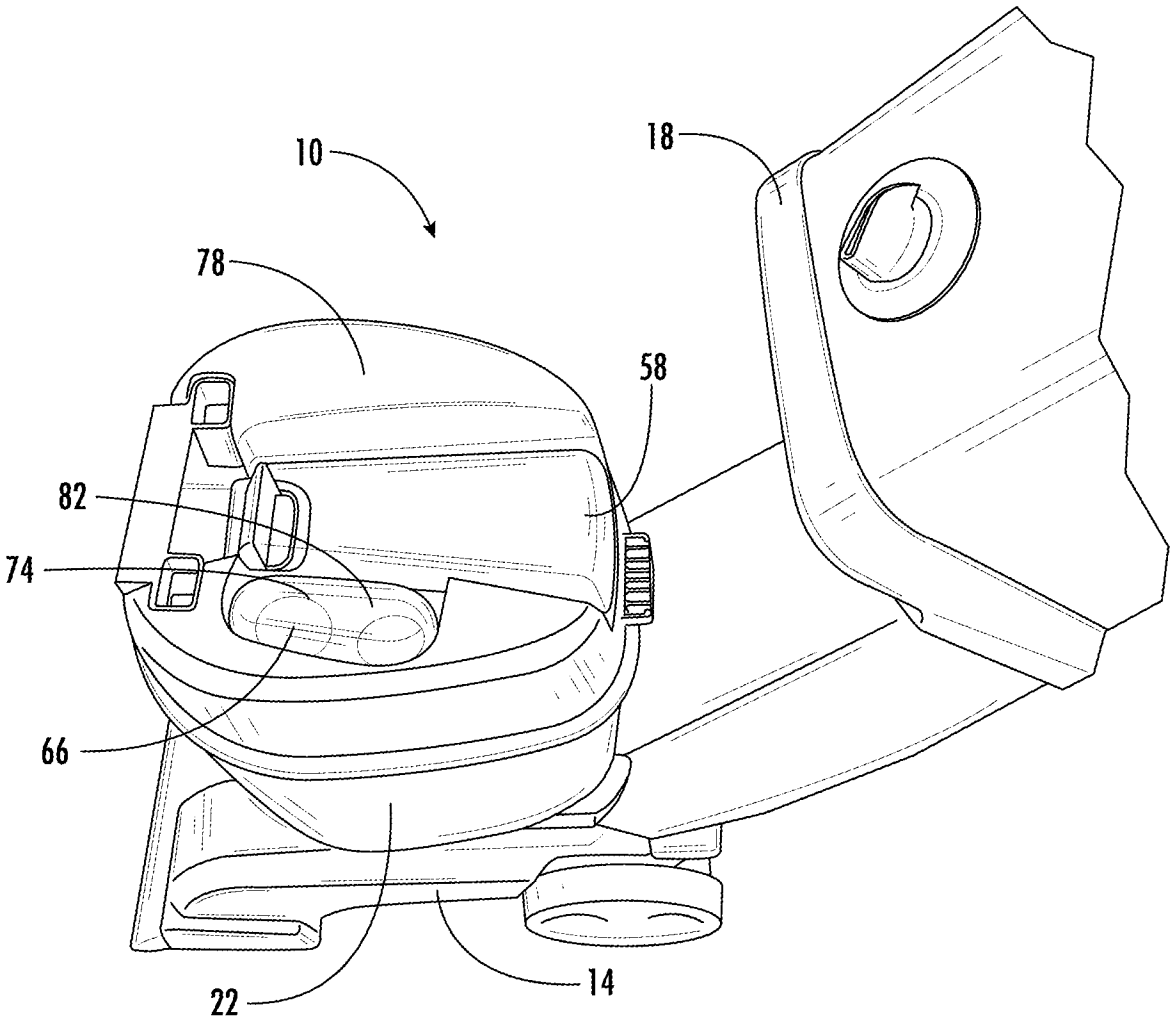
FIG. 2B is an alternative enlarged perspective view of the floor cleaner of FIG. 1 with the handle in the inclined use position.

Referring to FIGS. 1 and 2A-2B, an illustrated embodiment of the floor cleaner 10 includes a base 14, a handle 18, and a recovery tank 22. The base 14 is coupled to the handle 18 and adapted for movement across a surface to be cleaned. The handle 18 is movable between an upright storage position (FIG. 1) and an inclined use position (FIG. 2A). The floor cleaner 10 includes a fluid flow path 26 extending from a dirty air inlet 30 to a clean air outlet (not shown) and a suction source in the form of a motor 34 positioned in the fluid flow path 26.

Figure 3:
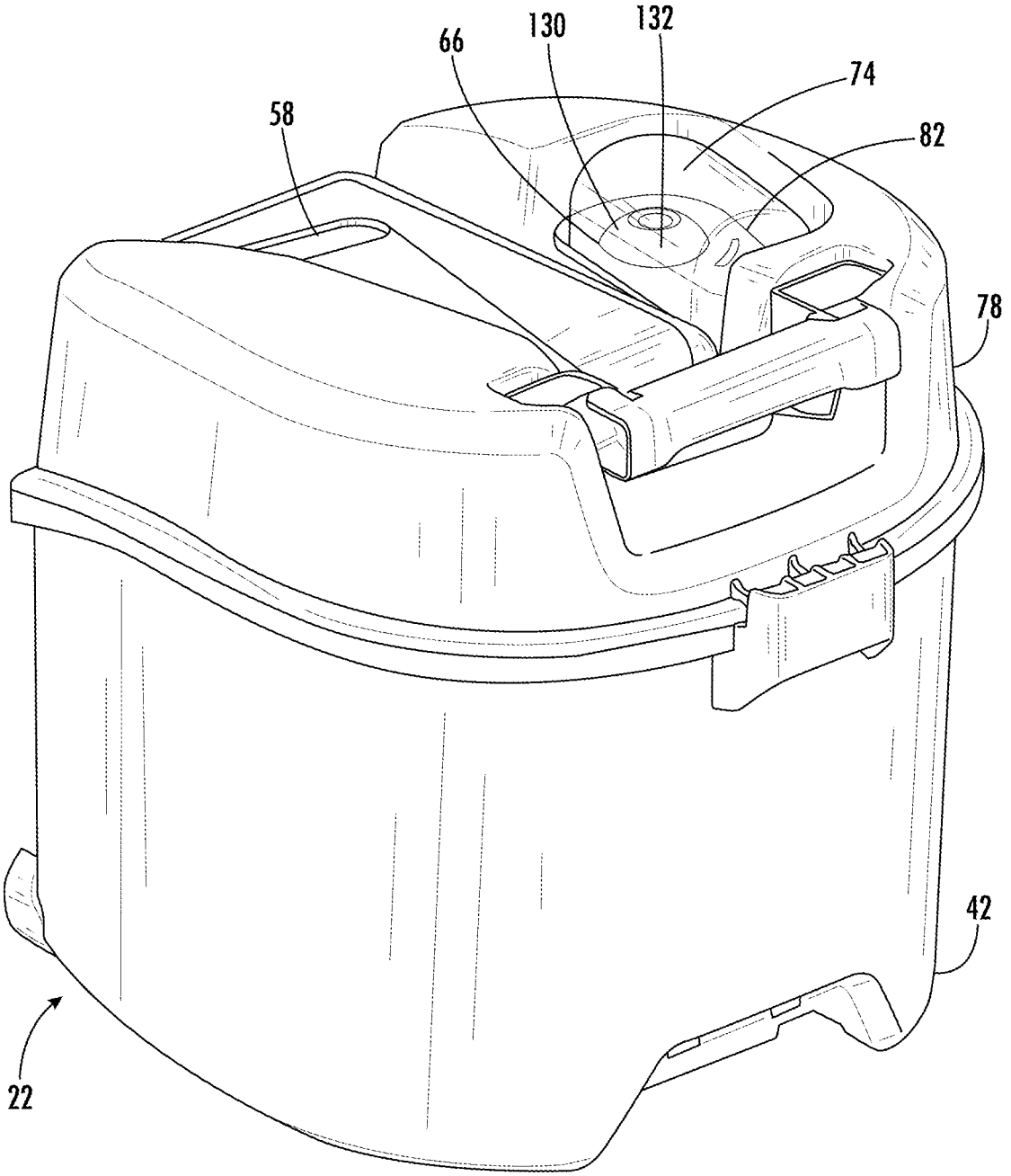
FIG. 3 is a perspective view of a recovery tank of the floor cleaner of FIG. 1.
Figure 4:
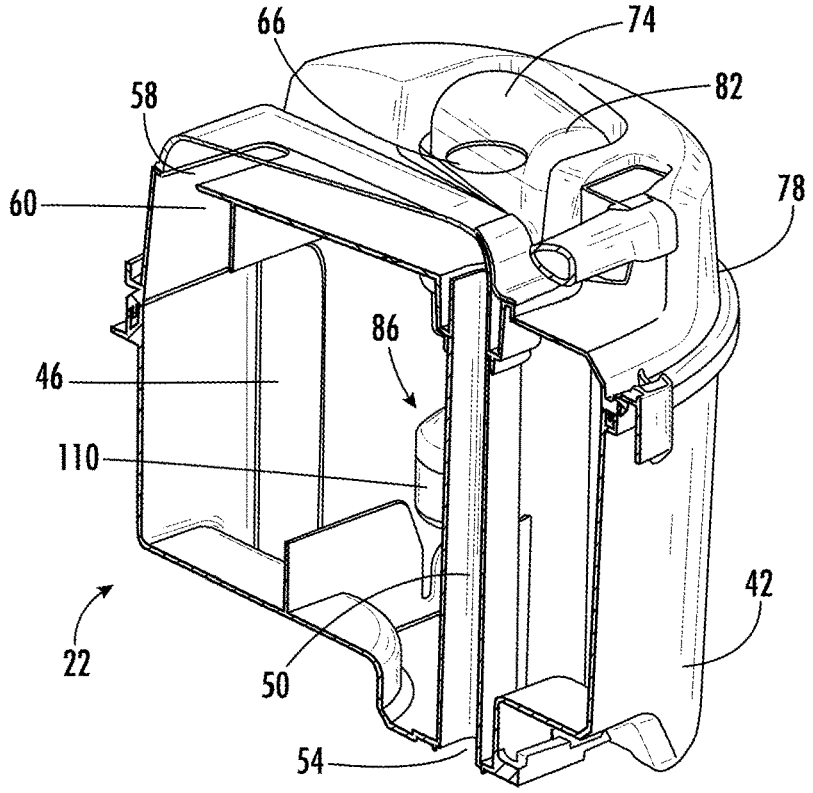
FIG. 4 is a perspective cross sectional view of the recovery tank of FIG. 3.
Figure 5:
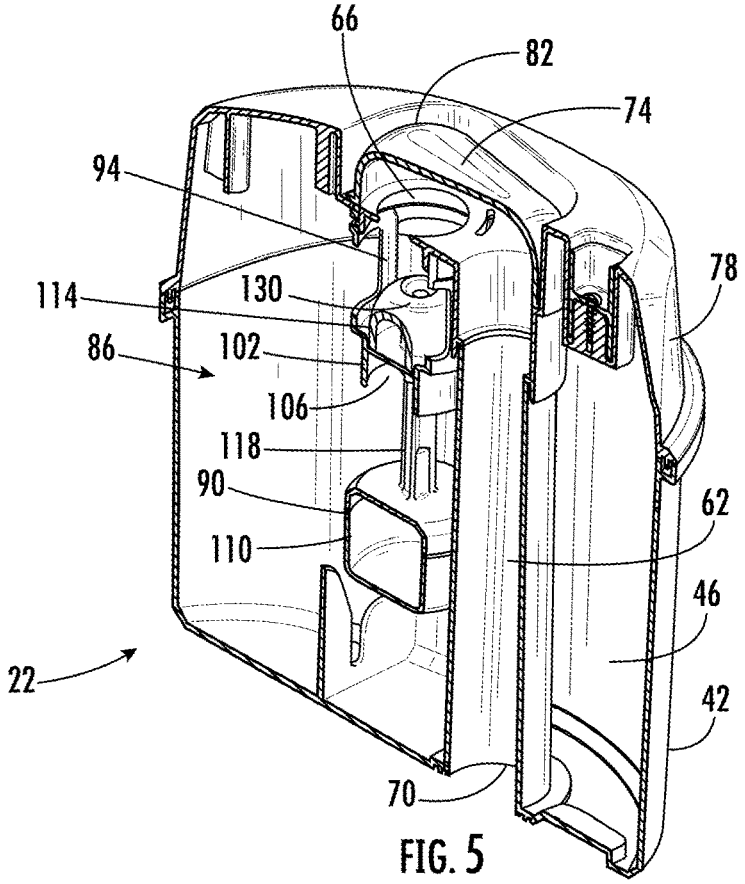
FIG. 5 is an alternative perspective cross sectional view of the recovery tank of FIG. 3.
Figure 8:
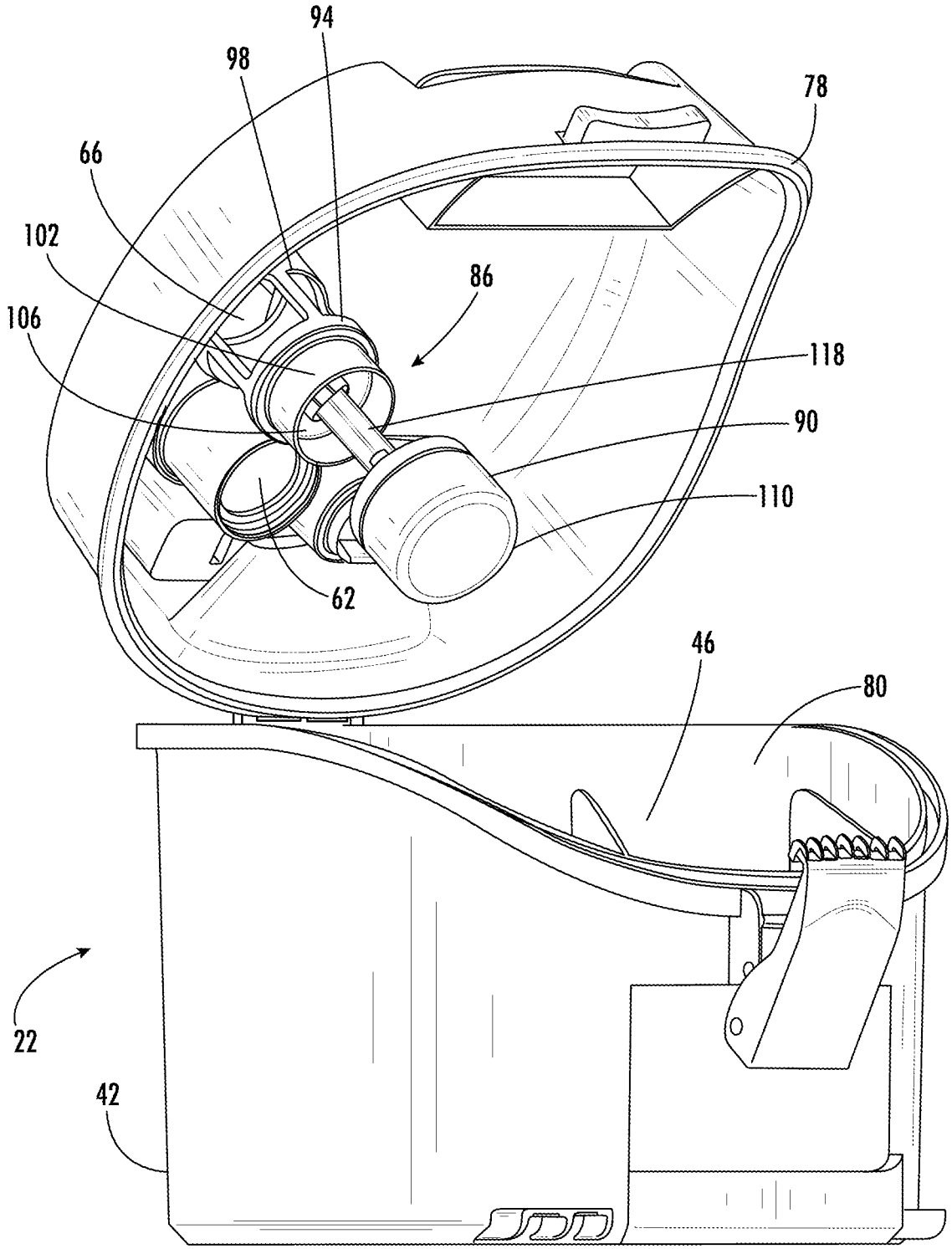
FIG. 8 is a perspective view of the recovery tank of FIG. 3 shown with an open lid.

As illustrated in FIGS. 3-5, the recovery tank 22 is positioned in the fluid flow path 26 in communication with the dirty air inlet 30. As shown in FIG. 3, the recovery tank 22 includes a container 42 and an inner chamber 46. The recovery tank 22 receives liquid-laden air through a recovery tank inlet passageway 50 in fluid communication with the dirty air inlet 30. The recovery tank inlet passageway 50 connects a recovery tank inlet 54 to a chamber inlet 58. The inner chamber 46 includes an air/liquid separator 60 that separates liquid out from the liquid-laden air. The recovery tank 22 expels clean and relatively dry air through a recovery tank outlet passageway 62 in fluid communication with the clean air outlet. The recovery tank outlet passageway 62 connects a chamber outlet 66 to a recovery tank outlet 70. Adjacent the chamber outlet 66 is a viewing port 74 visible to the operator of the cleaner. In one embodiment, the viewing port 74 is viewable by the operator during operation of the cleaner when the cleaner and the operator are in use positions. The recovery tank 22 includes a lid 78 removably coupled to the container 42 covering an access opening 80 in the container 42 (FIG. 8). In the illustrated embodiment, the chamber outlet 66 is disposed in the lid 78 of the recovery tank 22 as well as a portion of the recovery tank outlet passageway 62. The viewing port 74 includes a translucent or transparent portion 82 of the recovery tank outlet passageway 62. In one embodiment, the viewing port 74 is a translucent or transparent portion 82 of the recovery tank outlet passageway 62. The viewing port 74 is positioned in the top of the recovery tank 22 viewable from an overhead position, such as positioned in the top of the lid 78. In one embodiment, the viewing port 74 is positioned in a side portion of the recovery tank 22 viewable from the side, such as positioned in a side portion of the lid 78. In other embodiments, the viewing port 74 may be realized in other ways.

Figure 6:
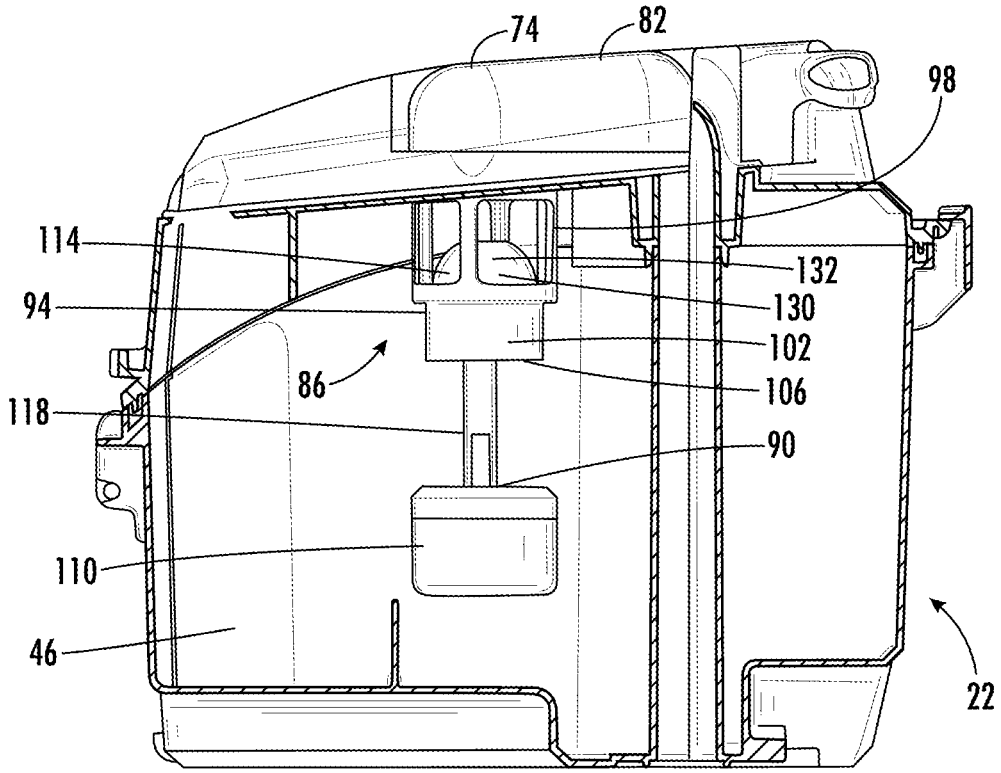
FIG. 6 is a side cross sectional view of the recovery tank of FIG. 3 shown with a float in an open position.
Figure 7:
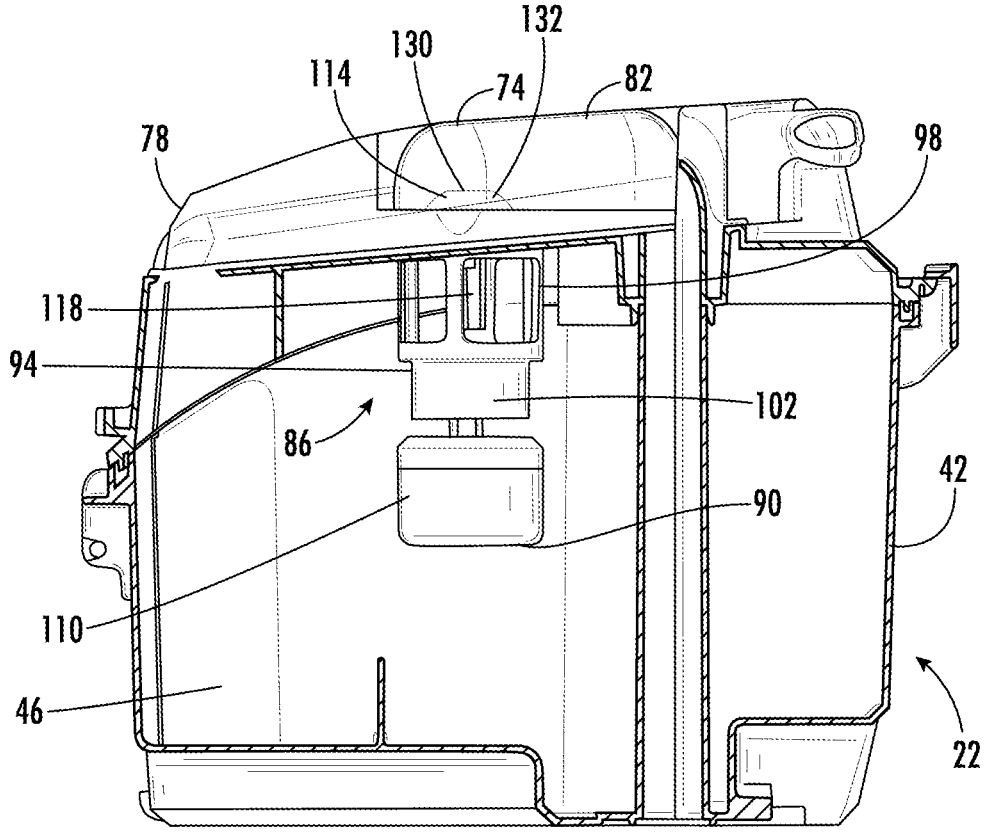
FIG. 7 is a side cross sectional view of the recovery tank of FIG. 3 shown with the float in a closed position.

Now referring to FIGS. 6 and 7, the recovery tank 22 has a float assembly 86 including a float 90 and a cage 94. The cage 94 is mounted to the lid 78 of the recovery tank 22 and is generally aligned with the chamber outlet 66. The cage 94 includes a plurality of ribs 98 forming air exhaust apertures between the ribs 98 and a lower rim 102 creating an aperture 106. The float 90 includes a base 110 and a valve 114 connected by a shaft 118. The valve 114 and the base 110 each have a width greater than a width of the aperture 106. The shaft 118 has a width smaller than the width of the aperture 106. The aperture 106 surrounds the shaft 118, thereby slideably retaining the float 90 in the cage 94. The float 90 is moveable between a first position (FIG. 6) and a second position (FIG. 7). In the first position, the valve 114 is spaced away from the chamber outlet 66. In the second position, or closed position, the valve 114 engages the chamber outlet 66.

During a cleaning operation, the motor 34 creates an air flow and pulls in liquid-laden air through the dirty air inlet 30. The liquid laden air travels through the recovery tank inlet passageway 50 to the chamber inlet 58. Liquid is then separated from the air by the air/liquid separator 60. Recovered liquid is stored in the inner chamber 46 and the cleaned air exits through the chamber outlet 66. The cleaned air travels through the recovery tank outlet passageway 62 and out the recovery tank outlet 70 on toward the motor 34 and out the clean air outlet. As the floor cleaner 10 continues its cleaning operation, a level of recovered liquid in the chamber increases. The rising liquid exerts a buoyant force on the base 110 of the float 90 causing it to rise from the first position. As the level of recovered liquid increases, the float 90 approaches the second position bringing the valve 114 adjacent the chamber outlet 66. The valve 114 aligns with and engages the chamber outlet 66, obstructing the fluid flow path 26. This obstruction halts the intake of liquid-laden air through the dirty air inlet 30 and therefore stops the level of recovered liquid from continuing to increase.

Figure 10:
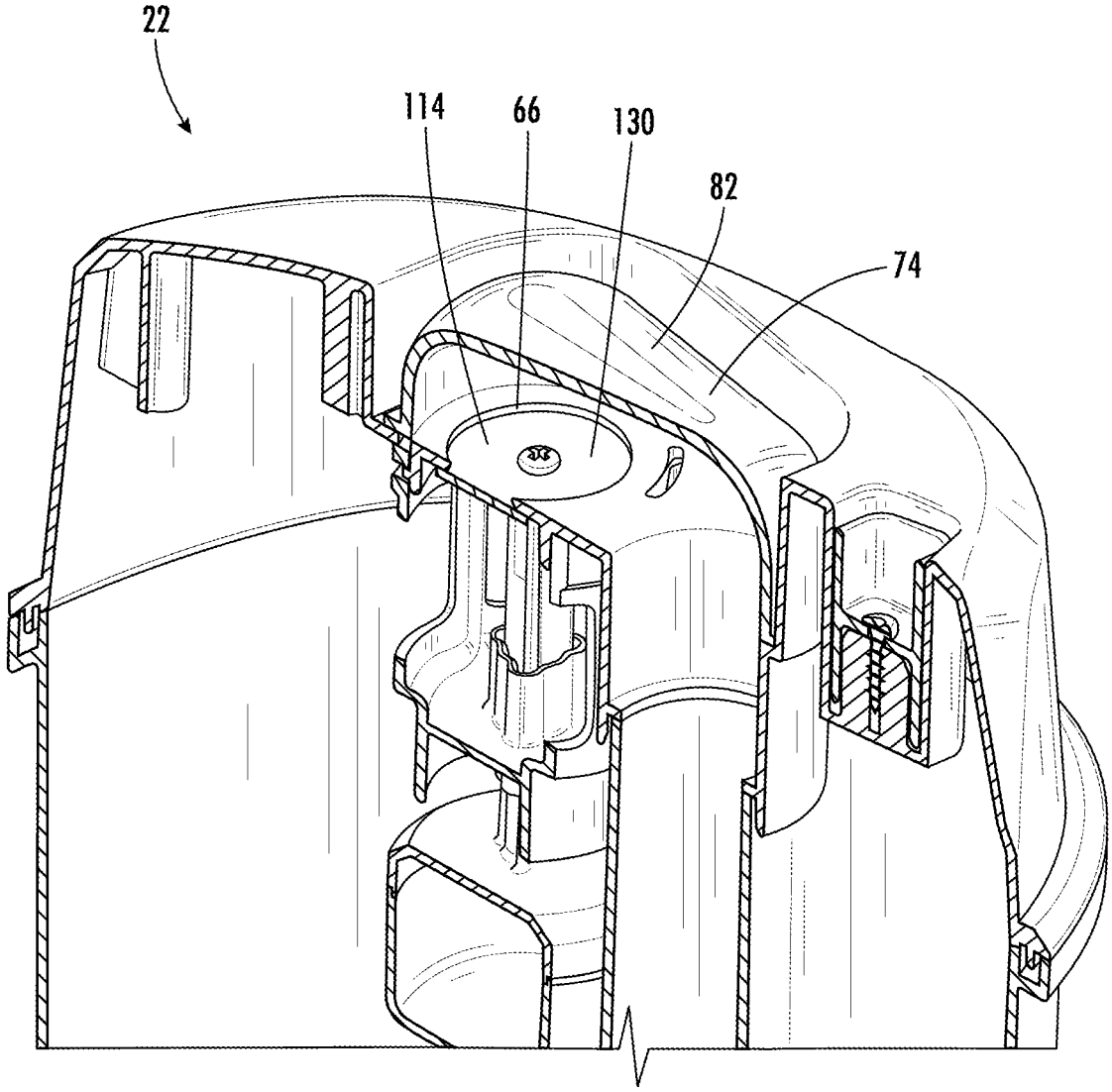
FIG. 10 is a perspective cross sectional view of a recovery tank according to another embodiment.

The valve 114 of the float 90 includes an indicator 130. This indicator 130 can include indicia 132 such as a colored surface, a shape, a graphic or logo, or an LED to enhance the noticeability of the indicator 130. The indicator 130 may formed by a surface or portion integral with or attached to the valve 114. The indicator 130 is configured to be visible through the viewing port 74 when the float rises to a predetermined level, such as indicating that the chamber 46 is full. The indicator 130 is arranged on the valve 114 to be visible through the viewing port 74 when the valve 114 is in the second, or closed, position engaging the chamber outlet 66. In one embodiment, the indicator 130 extends through the chamber outlet 66 into the recovery tank outlet passageway 62 when the valve 114 is in the second position. In one embodiment (FIG. 10), the valve 114 engages the underside of the chamber outlet 66 and the indicator 130 is viewable through the chamber outlet 66. The chamber outlet 66 has an aperture diameter or dimension sized to view the indicator 130 through the viewing port 74, such as greater than 12 mm, or between 12 and 150 mm. In one embodiment the dimension of the chamber outlet 66 is between 20 and 50 mm, and in one embodiment between 25 and 40 mm.

In the embodiment shown in FIGS. 1-2B, the recovery tank 22 is coupled to the base 14. In other embodiments, the recovery tank 22 may be operatively coupled to one or more other portions of the floor cleaner 10, such as the handle 18. FIG. 2B shows that the viewing port 74 is arranged such that the indicator 130 is visible to a user while the float 90 is in the second position and the floor cleaner 10 is in the inclined use position.

Referring to FIG. 8, the recovery tank 22 is removably coupled to the floor cleaner 10 to allow a user to remove the recovery tank 22 and empty the liquid contents. In operation, when the user is ready to empty the recovery tank 22, the user moves the lid 78 to expose the access opening 80. The user then may empty the dirty fluid from the container 42. Once the tank has been emptied, gravity causes the float 90 to return to the first position and the cleaning operation can continue. In other embodiments, the recovery tank 22 may not include a lid 78 and the liquid contents may be emptied in other ways.

Figure 9:
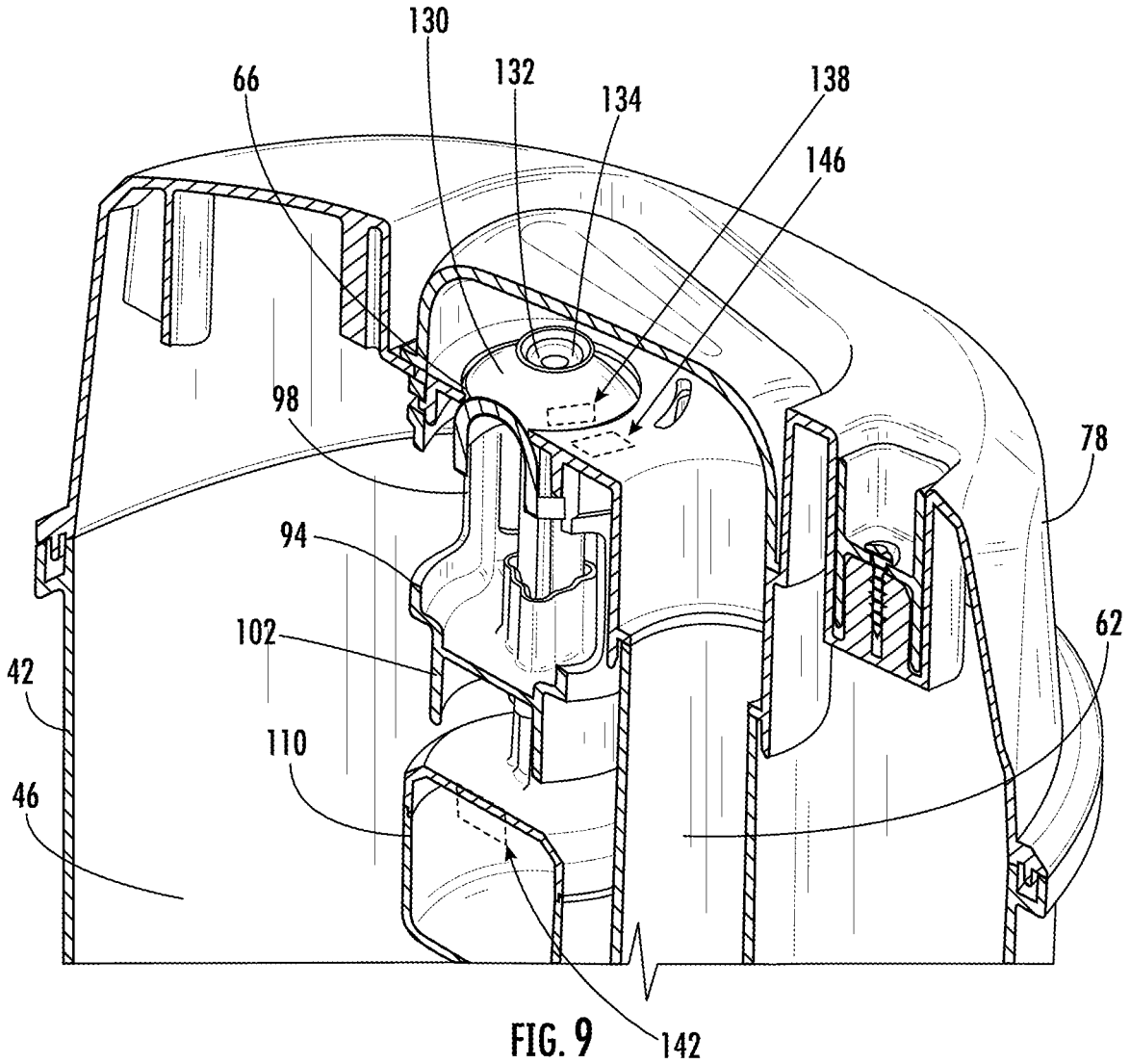
FIG. 9 is a perspective cross sectional view of a recovery tank according to another embodiment.

FIG. 9 illustrates an embodiment including an LED 134 as the indicia 132 on the indicator 130. The LED 134 and a switch 138 are mounted in the valve 114 and connected to a battery 142 stored in the base 110. A magnet 146 is mounted to the in the lid 78 adjacent the chamber outlet 66. As the float 90 approaches the second position and the valve 114 engages the chamber outlet 66 the switch 138 senses the magnet 146 and activates the LED 134. In other embodiments, the LED might be activated by a contact switch or other appropriate alternatives.

Other floor cleaners within the scope of this disclosure may include a different type of base, such as including the recovery tank and a supply tank coupled to the base. In addition, other extractors may be different than the illustrated upright configuration. For example, other embodiments of the extractor may include canister extractors or portable extractors also known as spot cleaners.

What is claimed is:

1. A floor cleaner comprising:

a recovery tank including, an inflow path allowing liquid-laden air to enter the recovery tank;

an outflow path allowing air to exit the recovery tank; and a chamber for storing liquid including, an inlet;

a separator that separates liquid from the liquid-laden air;

an air outlet; and a float including a base and a valve with an indicator, the float movable between a first position with the valve spaced away from the air outlet, allowing air to exit the chamber and a second position with the valve adjacent the air outlet, impeding the air from exiting the chamber, wherein the indicator is visible when the chamber is full.

2. The floor cleaner of claim 1, wherein the recovery tank further includes a viewing port adjacent the air outlet such that when the float is in the second position, the indicator is visible through the viewing port.

3. The floor cleaner of claim 2, wherein the viewing port is formed in a portion of the outflow path.

4. The floor cleaner of claim 3, wherein the viewing port is disposed in a top of the recovery tank.

5. The floor cleaner of claim 1, wherein the chamber includes a cage that guides the float between the first position and second position.

6. The floor cleaner of claim 1, wherein the indicator includes indicia to enhance the noticeability of the indicator.

7. The floor cleaner of claim 6, wherein the indicia includes at least one of a color, a pattern, or a graphic.

8. The floor cleaner of claim 6, wherein the indicia includes a light emitting diode.

9. The floor cleaner of claim 1, wherein the float is biased toward the first position by gravity and the float is moved to the second position by a buoyant force of the liquid acting on the base.

10. The floor cleaner of claim 1, wherein the outlet has a width dimension greater than 12 mm and less than 150 mm.

11. The floor cleaner of claim 1, wherein the float moves to the second position in response to a level of liquid in the chamber.

12. The floor cleaner of claim 11, wherein the valve includes a profile matching a profile of the air outlet and as the level of liquid in the chamber increases the valve profile aligns with the air outlet profile, allowing the valve to engage the air outlet thereby impeding the airflow.

13. The floor cleaner of claim 11, wherein the level of liquid in the chamber stops increasing when the float is in the second position.

14. The floor cleaner of claim 1, wherein the indicator passes through the air outlet when the valve is in the second position.

15. A floor cleaner comprising:

an inlet;

an outlet;

a suction source operable to generate a suction airflow through the inlet and the outlet;

a fluid flow path extending from the inlet to the outlet;

a recovery tank positioned in the fluid flow path and including a recovery tank inlet and a recovery tank outlet; and a float that obstructs the recovery tank outlet in a closed position of the float in response to a fluid level in the recovery tank, wherein the float includes an indicator visible when the float is in the closed position to indicate to the user that the float is in the closed position.

16. The floor cleaner of claim 15, wherein the indicator is visible through a viewing port in the recovery tank.

17. The floor cleaner of claim 16, wherein the recovery tank is mounted such that the viewing port is visible to the user when the floor cleaner is in an in-use position.

18. The floor cleaner of claim 16, wherein the viewing port is a portion of the recovery tank.

19. The floor cleaner of claim 16, wherein the indicator extends into the viewing port when the float is in the second position.

20. The floor cleaner of claim 15, wherein the float is in the closed position when the fluid level is at a predetermined level.

21. The floor cleaner of claim 15, wherein the recovery tank outlet includes an aperture with a diameter between 12 mm and 150 mm.

22. The floor cleaner of claim 15, wherein the indicator includes a light emitting diode activated by a switch in the closed position of the float.

* * * * *